US007749023B2

(12) United States Patent
Simmel et al.

(10) Patent No.: US 7,749,023 B2
(45) Date of Patent: Jul. 6, 2010

(54) PLUG CONNECTOR HAVING A SECONDARY LOCK FOR AN ELECTRICAL PLUG CONNECTION

(75) Inventors: Andreas Simmel, Schwaikheim (DE); Wolfgang Pade, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/227,616

(22) PCT Filed: Jul. 6, 2007

(86) PCT No.: PCT/EP2007/056868

§ 371 (c)(1),
(2), (4) Date: Apr. 8, 2009

(87) PCT Pub. No.: WO2008/019911

PCT Pub. Date: Feb. 21, 2008

(65) Prior Publication Data

US 2009/0318022 A1 Dec. 24, 2009

(30) Foreign Application Priority Data

Aug. 17, 2006 (DE) ..... 10 2006 038 535

(51) Int. Cl.
*H01R 13/40* (2006.01)

(52) U.S. Cl. ..... 439/595; 439/572

(58) Field of Classification Search ..... 439/752, 439/595

See application file for complete search history.

(56) References Cited

U.S. PATENT DOCUMENTS 4,944,695 A * 7/1990 Tsuji et al. ..... 439/595
4,959,023 A * 9/1990 Watanabe et al. ..... 439/752
4,975,082 A * 12/1990 Nagasaka et al. ..... 439/595
5,085,599 A 2/1992 Maejima et al.
5,122,080 A * 6/1992 Hatagishi et al. ..... 439/752
5,904,593 A 5/1999 Saito et al.
6,702,625 B2 3/2004 Endo
7,335,061 B2 * 2/2008 Ciriello et al. ..... 439/595
2002/0076992 A1 6/2002 Kurimoto et al.

FOREIGN PATENT DOCUMENTS

DE 102 46 702 4/2003

* cited by examiner

*Primary Examiner*—Briggitte R Hammond
(74) *Attorney, Agent, or Firm*—Kenyon & Kenyon LLP

(57) ABSTRACT

A plug connector for an electrical plug connection including a contact chamber housing, having a plurality of contact chambers for receiving a contact body each, which is introducible into the contact chamber and is primarily engaged in the contact chamber housing in its end position, and having a secondary locking element which is guided displaceably across the direction of introduction of the contact bodies and which, in its locking position, respectively protrudes laterally into the contact chambers with a locking projection for secondarily locking the contact bodies primarily engaged there. The contact chamber housing is subdivided into a plurality of contact chamber housing sections each having at least one series of contact chambers by one or more parallel separating gaps, each of the contact chambers being open toward a separating gap or an outside of the contact chamber housing parallel thereto, the secondary locking element is a frame subdivided into compartments by one or more parallel partitions, the partitions engaging into the separating gaps when the secondary locking element is plugged onto the contact chamber housing, closing the laterally open contact chambers, and the secondary locking element plugged onto the contact chamber housing is displaceably guided across the direction of introduction of the contact bodies into the locking position.

9 Claims, 7 Drawing Sheets

PLUG CONNECTOR HAVING A SECONDARY LOCK FOR AN ELECTRICAL PLUG CONNECTION

FIELD OF THE INVENTION

The present invention is directed to a plug connector for an electrical plug connection.

BACKGROUND INFORMATION

Electrical plug connections are provided for producing a detachable electrical connection, for example, between an electrical conductor and another electrical conductor or between an electrical conductor and an electrical unit via their two components (socket component and plug component).

A known plug connection is made up of a metallic contact having a crimp or solder, metallic pins, two plug connector housings made of plastic (thermoplastic), as well as sealing elements (elastomers) and additional holding elements for the contacts, so-called secondary locks. One component of the plug connection is a so-called cable harness plug connector, which may also contain holding elements such as secondary locks. The other component of the plug connection is a so-called coupling plug connector, which has at least three components, namely a plug connector housing, a contact support bottom, and a secondary locking element. These three components mean that three injection molding dies must be available to manufacture the components, and the three components must be joined to form the coupling plug connector.

SUMMARY OF THE INVENTION

An object of the exemplary embodiments and/or exemplary methods of the present invention is to further reduce the number of components in a plug connector of the above-mentioned type.

This object is achieved according to the exemplary embodiments and/or exemplary methods of the present invention by a plug connector having the features described herein.

The plug connector according to the present invention has only two plastic (for example, thermoplastic) components, namely the contact chamber housing and the secondary locking element, which has a dual function. On the one hand, it is used as a secondary lock of the electrical contacts in the plug connector (pins); on the other hand, it forms a part of the chamber wall (for example, the fourth face) of the contact chamber in the contact chamber housing. This makes it possible to manufacture the contact chamber housing in the plug connector by the injection molding method as a single part. An internal and/or an external coding may be integrated into the plug connector. Due to the two-part design of the plug connector according to the exemplary embodiments and/or exemplary methods of the present invention, the previously required third plastic component is omitted, so that the manufacture and assembly of the third plastic component in the plug connector are no longer needed.

Further advantages and advantageous embodiments of the subject matter of the present invention are presented in the description, the drawings, and the claims.

Various exemplary embodiments of the plug connector according to the present invention are illustrated in the drawings and explained in greater detail in the description that follows.

DETAILED DESCRIPTION

Figure 1:
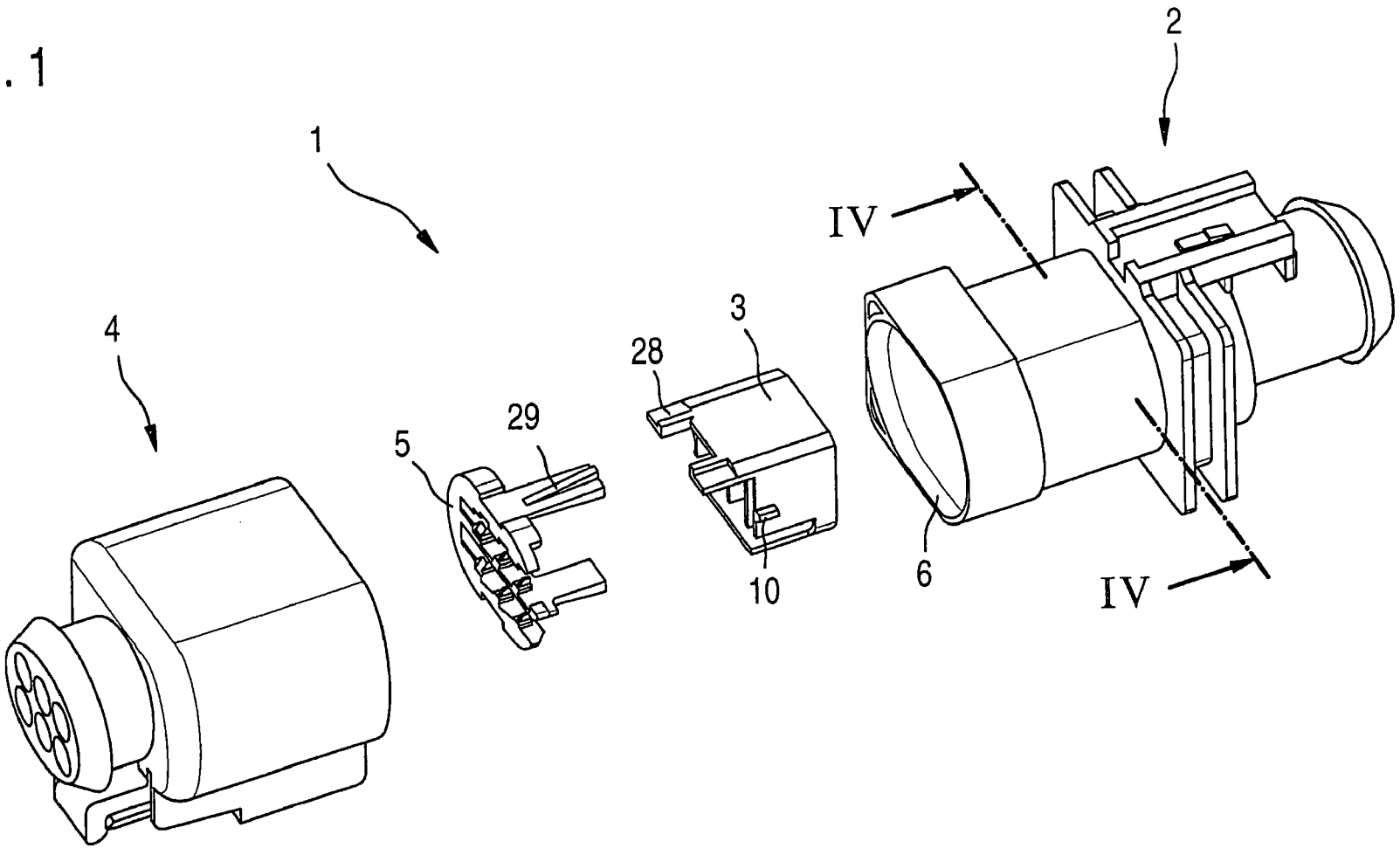
FIG. 1 shows the individual components of an electrical plug connection between a coupling plug connector according to the present invention and a cable harness plug connector.

Electrical plug connection 1 shown in FIG. 1 includes a coupling plug connector 2 having a secondary locking element 3 inserted therein and a cable harness plug connector 4 having a sampling element 5 inserted therein. Coupling plug connector 2 has a receptacle 6 in front for insertion into a corresponding socket (not shown) of cable harness plug connector 4.

Figure 2:
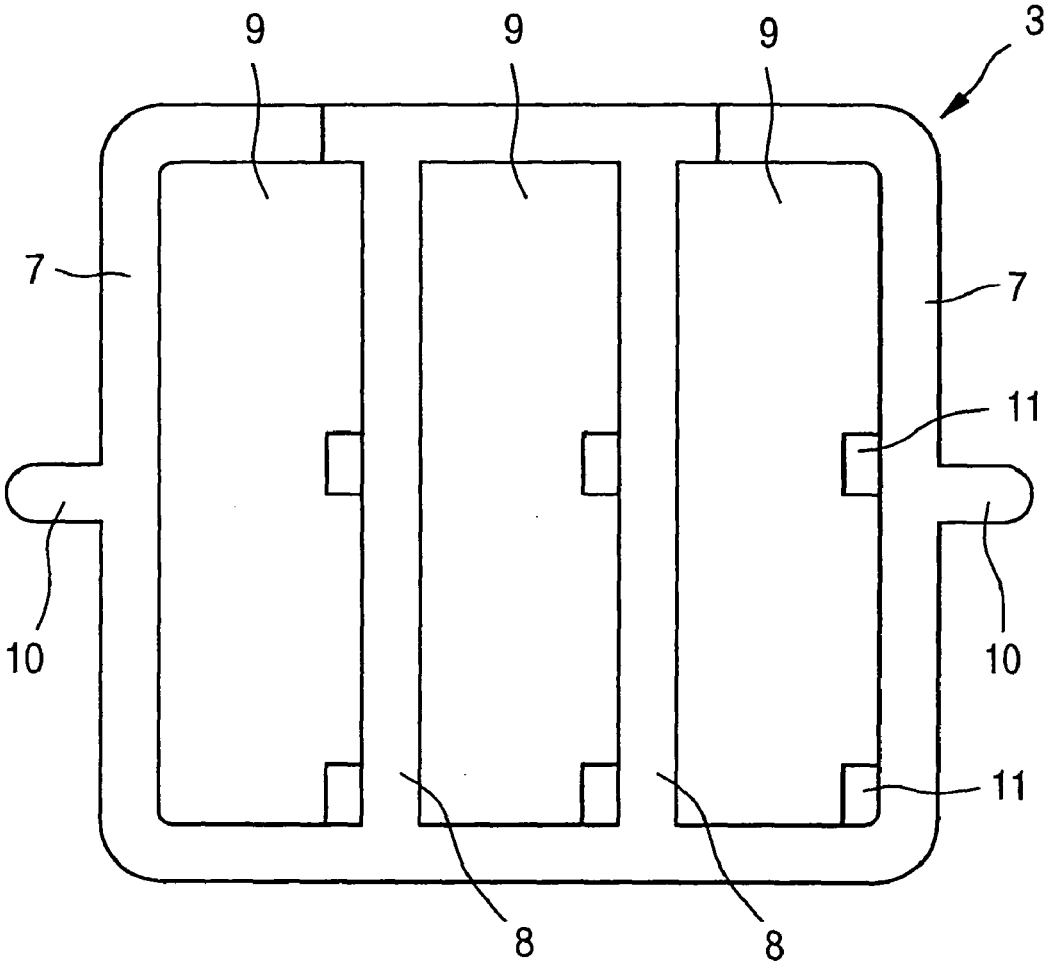
FIG. 2 shows the front of a secondary locking element of the coupling plug connector shown in FIG. 1.

As shown in FIG. 2, secondary locking element 3 is designed as a frame having frame walls 7 and two parallel partitions 8, which subdivide the frame opening into three parallel compartments 9. On the outside of frame walls 7 shown on the right and left in FIG. 2, a latch cam 10 protruding laterally outward is provided in front of each. On right-hand frame wall 7 and on both partitions 8 two locking projections 11, which protrude laterally into the respective left-hand compartments 9, are provided on both sides of each.

Figure 3A:
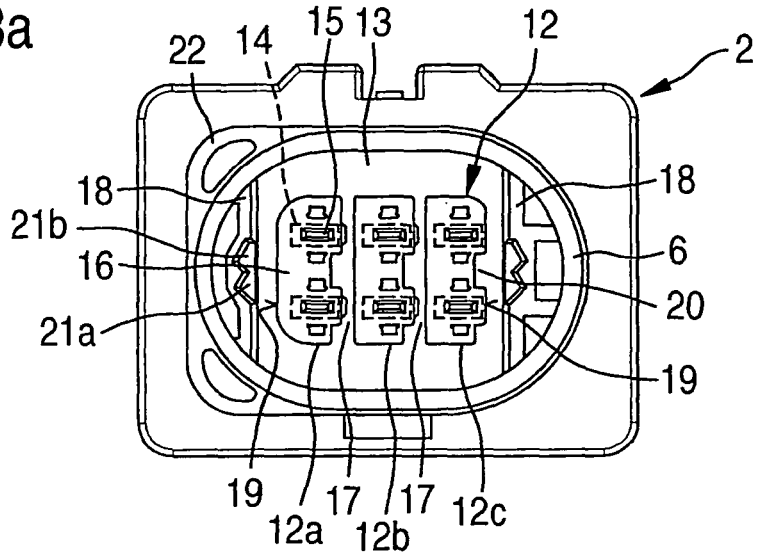
FIGS. 3*a*, 3*b* and 3*c* show the front view of the coupling plug connector of FIG. 1 without a secondary locking element (FIG. 3*a*) and with the secondary locking element in its pre-assembled position (FIG. 3*b*) and in its locking position (FIG. 3*c*).

FIG. 3*a* shows the front view of coupling plug connector 2 without secondary locking element 3. Within receptacle 6, coupling plug connector 2 has a contact chamber housing 12 which extends from a sleeve bottom 13 of receptacle 6 forward and includes six contact chambers 14 in a 3×2 arrangement. Pins or flat plugs (contact bodies) 15, which are pushed in from the back through openings in sleeve bottom 13 and protrude forward from openings of front walls 16 of contact chambers 14, are situated in contact chambers 14. Pins 15 are lance contacts having protruding hooks which are primarily engaged in an undercut in contact chamber 14. Two separating gaps 17 subdivide contact chamber housing 12 into three contact chamber housing sections 12*a* through 12*c* each having an upper and a lower contact chamber 14. Contact chamber housing 12 is annularly spaced from the inside of receptacle 6 and is situated between two intermediary walls 18 of receptacle 6, outsides 19 of contact chamber housing 12, parallel to separating gaps 17, being spaced from intermediary walls 18. Contact chambers 14 are open between their front walls 16 and sleeve bottom 13 on their right-hand side in FIG. 3 to separating gaps 17 and to right-hand (in FIG. 3) outside 19. On this open side, each front wall 16 of contact chambers 14 has a recess 20 open to the respective separating gap 17, i.e., to right-hand outside 19. Two catch recesses 21*a*, 21*b* are provided in the two intermediary walls 18, and receptacle 6 also has an outside coding 22, which is described in more detail below with reference to FIGS. 6 and 7.

Figure 3B:
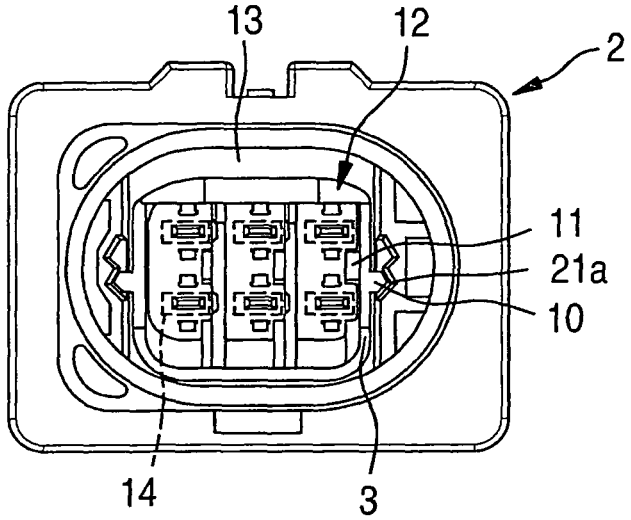
Figure 3C:
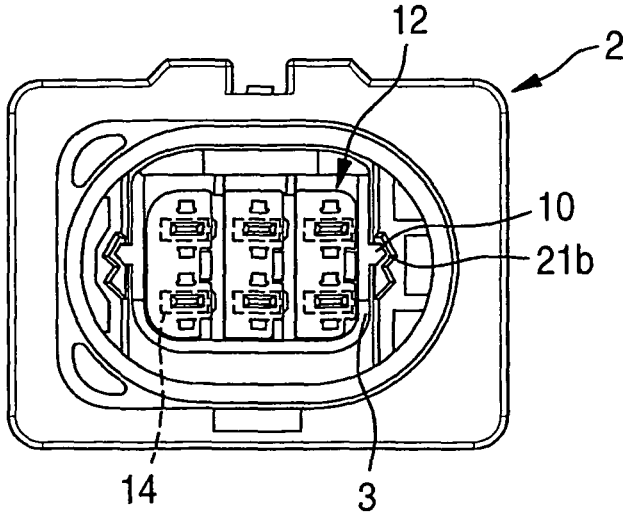

Secondary locking element 3 is plugged onto contact chamber housing 12 until it contacts sleeve bottom 13, it being guided, using its locking projections 11, through recesses 20 in front walls 16, engaging with its partitions 7 in separating gaps 17 and being guided on contact chamber housing 12 over its frame walls and/or partitions 7, 8. FIG. 3*b* shows this preassembled position of secondary locking element 3 in which latch cams 10 engage in lower (in FIG. 3) catch recesses 21*a*. By displacing preassembled secondary locking element 3 across the direction of introduction of pins 15, i.e., upward in FIG. 3*b*, it is placed into the locking position shown in FIG. 3*c*, in which locking projection 11 protrudes laterally into contact chambers 14 for secondarily locking pins 15 which are primarily engaged there and latch cams 10 engage into upper (in FIG. 3) catch recesses 21*b*.

Figure 4A:
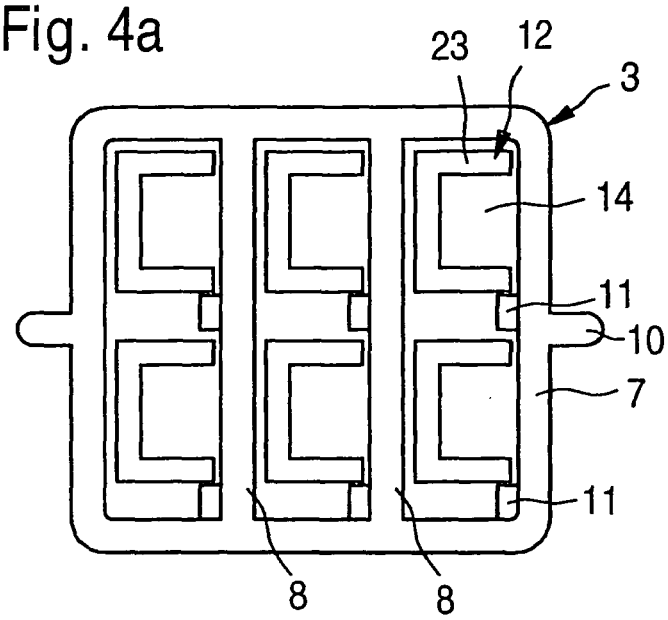
FIGS. 4*a*, 4*b* and 4*c* show the coupling plug connector shown in FIG. 3 having the secondary locking element in the pre-assembled position (FIG. 4*a*) and in the locking position (FIG. 4*c*), each in a sectioned view IV-IV in FIG. 1 and in a detail view (FIG. 4*b*) according to IVb in FIG. 4*c*.
Figure 4B:
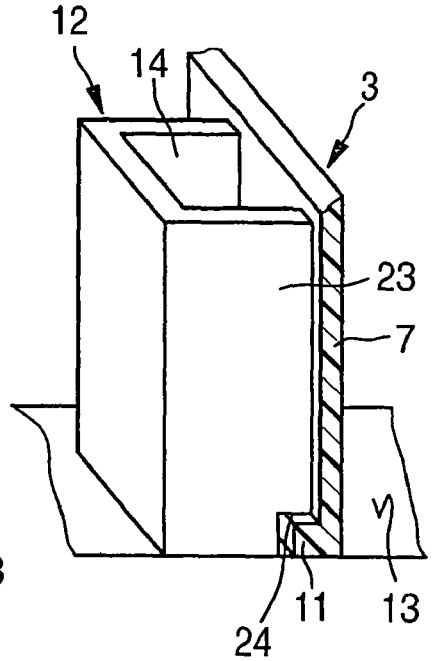
Figure 4C:
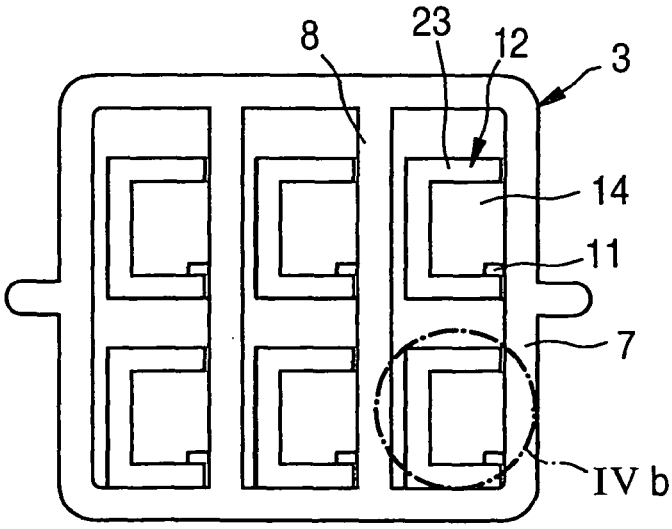

FIG. 4*a* shows a section through contact chamber housing 12 having preassembled secondary locking element 3 in a section plane parallel to front wall 16 of contact chambers 14. Rectangular contact chambers 14 are each formed by three chamber walls 23 of contact chamber housing 12 and by the frame walls and partitions 7, 8 of inserted secondary locking element 3. As FIG. 4*b* shows, one chamber wall 23 of contact chambers 14 has a recess 24 on sleeve bottom 13, through which locking projection 11 is pushed into contact chamber 14 when secondary locking element 3 is displaced into the locking position (FIG. 4*c*).

Coupling plug connector 2 is assembled as follows: First, secondary locking element 3 is inserted into its preassembled position; then pins 15 are introduced into contact chambers 14 through the openings in sleeve bottom 13, i.e., from the back of coupling plug connector 2. Finally, secondary locking element 3 is displaced into its locking position, whereby locking projections 11 in contact chambers 14 engage in undercuts 25 of pins 15 (FIG. 5*a*) in their direction of introduction, thus locking pins 15 into their correct introduced position. Secondary locking element 3 may be displaced into its locking position only if all pins 15 are in their correct introduced position; otherwise the position of pins 15 must be checked.

Figure 5A:
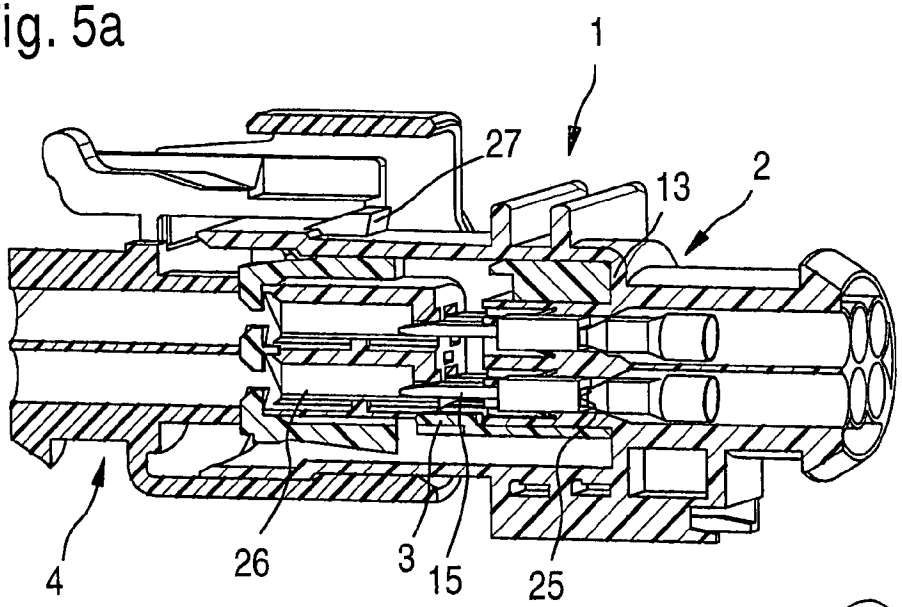
FIGS. 5*a* and 5*b* show a longitudinal section through the plugged-together coupling and cable harness plug connectors of the plug connection shown in FIG. 1 (FIG. 5*a*) and through the coupling plug connector (FIG. 5*b*).
Figure 5B:
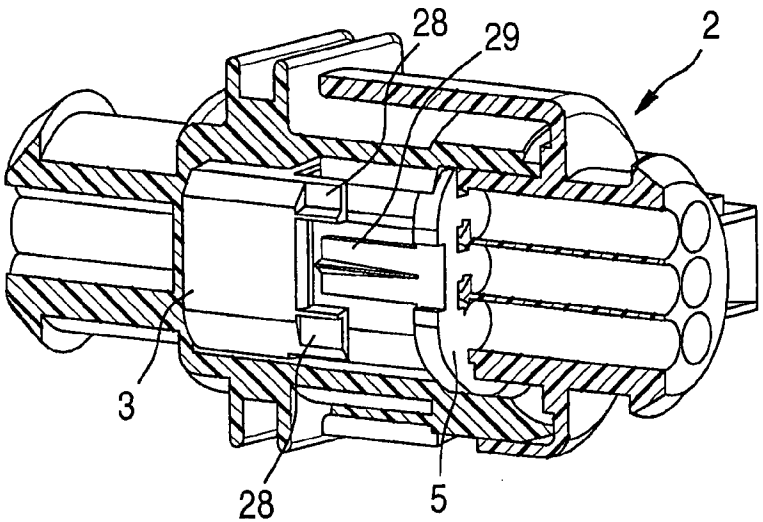

FIG. 5*a* shows a longitudinal section through the coupling plug connector 2 and cable harness plug connector 4 plugged into each other. Cable harness plug connector 4 has appropriate mating contacts 26 into which pins 15 of coupling plug connector 2 engage. On the outside of receptacle 6 one more latch cam 27 is provided for engaging coupling plug connector 2 with cable harness plug connector 4. As FIG. 5*b* shows, secondary locking element 3 has two forward projecting locking projections 28 and sampling element 5 of cable harness plug connector 4 has a sampling arm 29. Only when secondary locking element 3 is in its locking position may sampling arm 29 engage between the two locking projections 28, thus forming the plug connection between coupling plug connector 2 and cable harness plug connector 4.

Figure 6A:
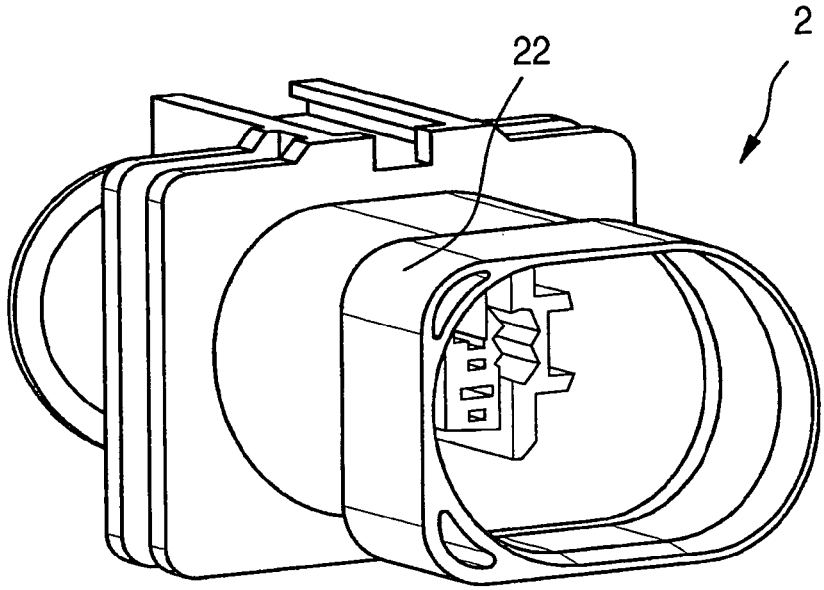
FIGS. 6*a* and 6*b* show the coupling plug connector of FIG. 1 having two different external codings.
Figure 6B:
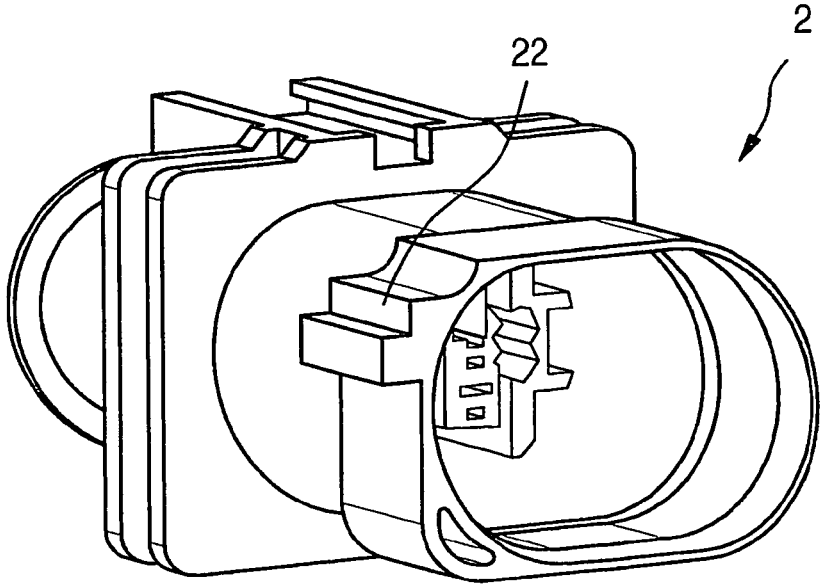
Figure 7A:
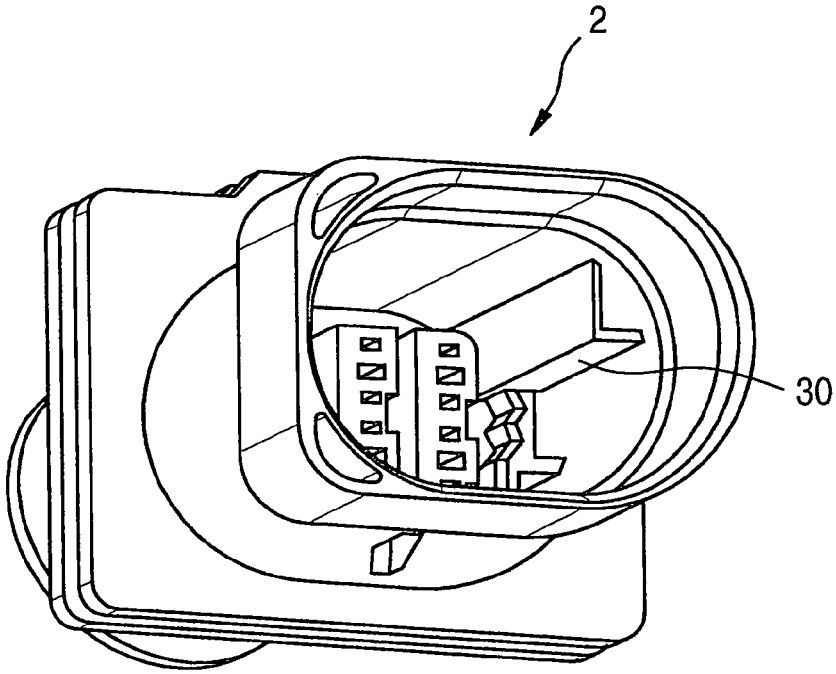
FIGS. 7*a* and 7*b* show the coupling plug connector of FIG. 1 having two different internal codings.
Figure 7B:
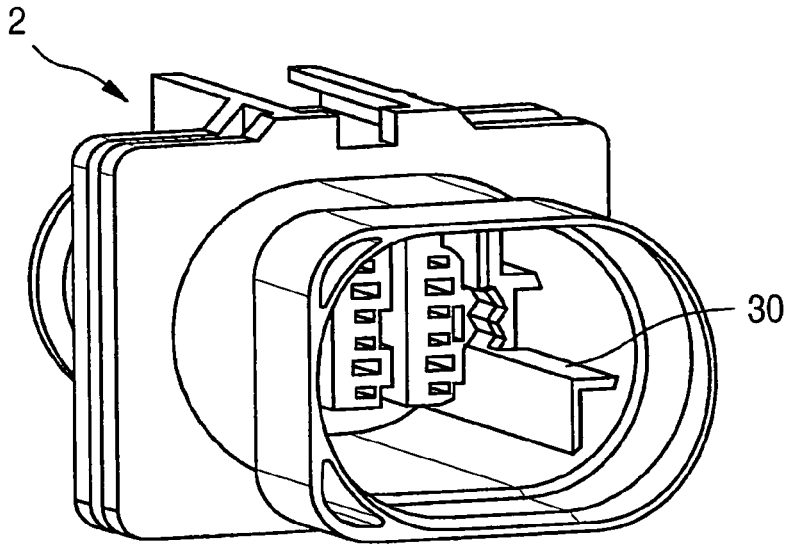

FIGS. 6*a*, 6*b* show coupling plug connector 2 having two different external codings 22, and FIGS. 7*a*, 7*b* show coupling plug connector 2 having two different internal codings 30. These codings 22, 30, in combination with a corresponding countercoding (not shown) of cable harness plug connector 4, are used for preventing mismatches if a plurality of plug connectors of the same type is used in a system.

What is claimed is:

1. A plug connector for an electrical plug connection, comprising:

a contact chamber housing having:

a plurality of contact chambers for each receiving a contact body, which is introducible into the contact chamber and is primarily engaged in its end position in the contact chamber housing; and a secondary locking element which is guided displaceably across a direction of introduction of the contact bodies and which, in its locking position, protrudes respectively with a locking projection laterally into the contact chambers for secondarily locking the contact bodies primarily engaged there;

wherein the contact chamber housing is subdivided into a plurality of contact chamber housing sections each having at least one series of contact chambers, by at least one parallel separating gap, each of the contact chambers being open to a separating gap or an outside of the contact chamber housing parallel thereto, and the secondary locking element is a frame subdivided into compartments by at least one parallel partition of the frame engaging into the separating gaps and closing the laterally open contact chambers when the secondary locking element is plugged onto the contact chamber housing, and the secondary locking element plugged onto the contact chamber housing is displaceably guided across the direction of introduction of the contact bodies into the locking position.

2. The plug connector of claim 1, wherein all contact chambers are open toward the same side.

3. The plug connector of claim 1, wherein the contact chambers are laterally open except for a front wall.

4. The plug connector of claim 3, wherein the front wall has a recess, open to one of the particular separating gap and the outside of the contact chamber housing, for the locking projection.

5. The plug connector of claim 1, wherein the contact chambers each have one chamber wall having a recess through which locking projection is pushed into the particular contact chamber when the secondary locking element is displaced into the locking position.

6. The plug connector of claim 1, wherein the secondary locking element is engaged on the housing side at least in its locking position.

7. The plug connector of claim 6, wherein the secondary locking element has at least one latch cam, which engages in a housing-side catch recess, at least in the locking position.

8. The plug connector of claim 1, wherein the secondary locking element has a locking projection extending forward.

9. The plug connector of claim 1, wherein at least one of external codings and internal codings are provided on the plug-in cross section of the plug connector.

* * * * *